US005578327A

United States Patent [19]

Tan

[11] Patent Number: 5,578,327

[45] Date of Patent: Nov. 26, 1996

[54] PLASTERING MACHINE

[76] Inventor: Tah H. Tan, 65, Leboh Tamarind, Off Teluk Gadung Road, Southern Park, Kelang, 41200 Selangor, Malaysia

[21] Appl. No.: 289,393

[22] Filed: Aug. 12, 1994

[30] Foreign Application Priority Data

Aug. 16, 1993 [MY] Malaysia ..... PI 930 1619

[51] Int. Cl.[6] ..... E04F 21/06

[52] U.S. Cl. ..... 425/62; 401/48; 401/131; 401/137; 401/139; 401/146; 401/267; 425/87; 425/219; 425/432

[58] Field of Search ..... 425/62, 87, 219, 425/432, 458; 401/48, 131, 137, 139, 143, 146, 261, 267

[56] References Cited

U.S. PATENT DOCUMENTS

| | | | |
|---|---|---|---|
| 88,135 | 3/1869 | Coburn | 401/48 |
| 92,985 | 7/1869 | McKinley | 401/48 |
| 145,459 | 12/1873 | Stevens et al. | 401/48 |
| 4,185,950 | 1/1980 | Lindskog | 425/87 |
| 4,781,556 | 11/1988 | Paul | 425/87 |
| 4,907,955 | 3/1990 | Snipes | 425/87 |

*Primary Examiner*—James P. Mackey
*Attorney, Agent, or Firm*—Lowe, Price, LeBlanc & Becker

[57] ABSTRACT

A plastering machine is formed to apply and compact cement-sand mortar plaster onto a vertical wall surface. A container (30) for holding and applying mortar is attached to a frame assembly moveable along both a vertical axis and horizontal axis. The container is supported by a frame-assembly (16) which includes vertical moveable frame members (18, 20) energized by hydraulic means, mounted onto a base frame (2). The base-frame (2) is fitted with swivel caster wheels (4) and angled roller wheels (6). A vibration rod (44) is provided within the container (38). A cutter and smoothening device (42) is provided to smoothen the plaster applied to the wall surface.

12 Claims, 4 Drawing Sheets

PLASTERING MACHINE

FIELD OF THE INVENTION

This invention relates to a plastering and in particular to a machine to apply cement-sand mortar plaster onto brick wall, or concrete wall surfaces to provide a substantially smooth surface.

BACKGROUND OF THE RELATED ART

In the construction of buildings, the exposed brick wall surfaces or concrete wall surfaces, which are often rough or uneven, are generally plastered with cement-sand mortar to provide a substantially smooth surface. This application of cement-sand mortar plaster is typically done manually. The manual plastering method is labor intensive and generally does not always result in uniform plastered surfaces, if the task is undertaken by persons lacking the necessary skills. Further, the manual rate of application of plaster is also slow.

Various attempts have been made to introduce mechanical contrivances to apply plaster onto walls. In one such example, cement plaster is sprayed onto the wall, resulting in a rough surface. The inventor is not aware of any other machines or contrivances used to apply plaster onto walls.

SUMMARY OF THE INVENTION

A principal object of this invention is to provide a plastering machine to apply cement-sand mortar plaster onto a substantially planar vertical surface.

The plastering machine in the preferred embodiment includes a container secured to a frame assembly means capable of vertical movement to hold and to apply cement sand mortar plaster onto the planar structure. The frame assembly includes an outer pair of frame members which are non-moveably fixed onto a base frame and an inner pair of frame members longitudinal moveable along the outer pair of frame members. The travelling frame member is secured to rollers which are slideable along a pair of grooves in the inner pair of frame members. A vibration means is provided and includes a vibration rod disposed horizontally along the length of the container. The plastering machine is mounted onto a fixed set of wheels and a set of hydraulically mounted roller wheels and the base frame can be raised above ground level.

BRIEF DESCRIPTION OF THE DRAWINGS

In order that the invention may be move clearly understood reference will now be made to the accompanying drawings which show a preferred embodiment thereof by way of example and in which.

DETAILED DESCRIPTION OF THE PREFERRED EMBODIMENTS

Figure 1:
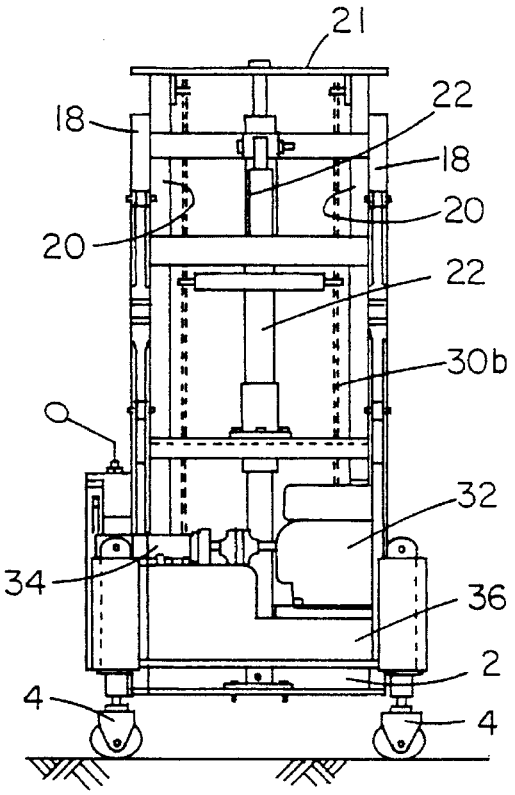
FIG. 1 is a rear elevation view of a preferred embodiment of the invention.
Figure 2:
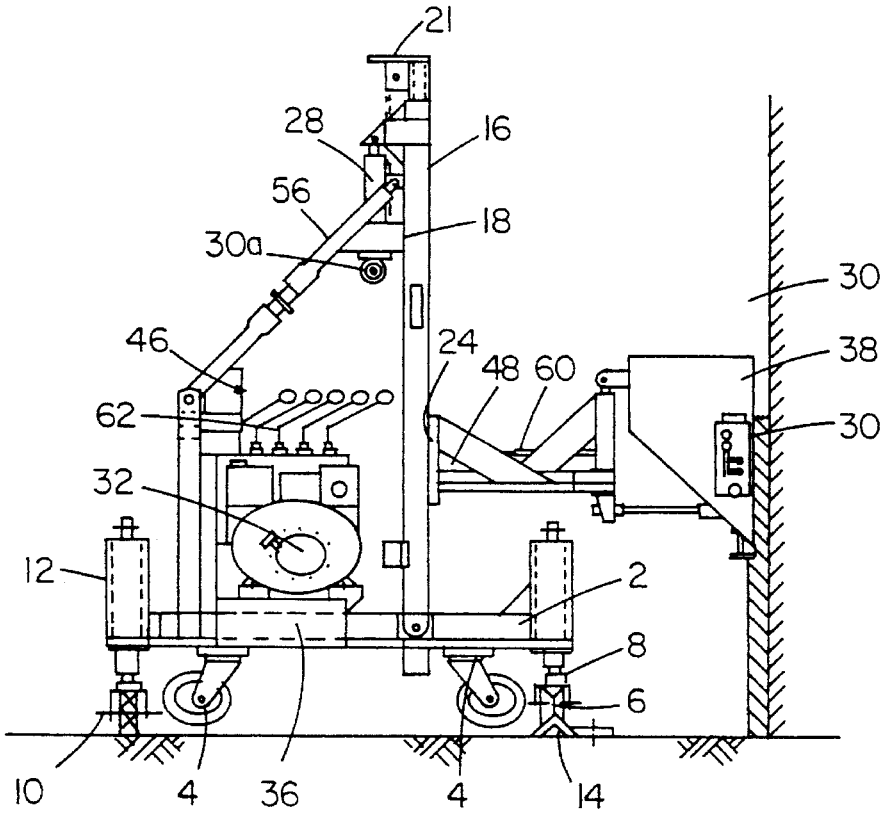
FIG. 2 is a side elevation view of the preferred embodiment.
Figure 3A:
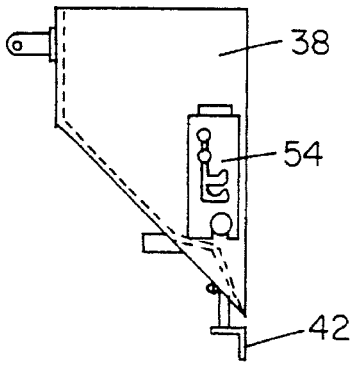
FIG. 3(*a*), (*b*), (*c*) and (*d*) shows details of a container and vibrator locking device.
Figure 3B:
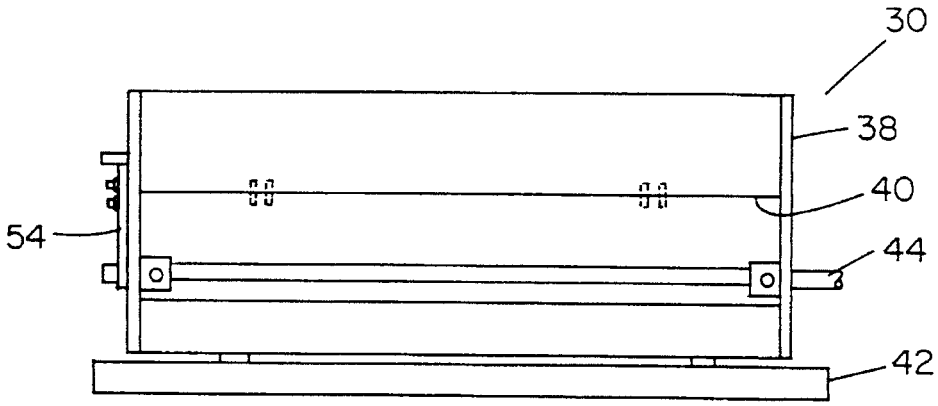
Figure 3C:
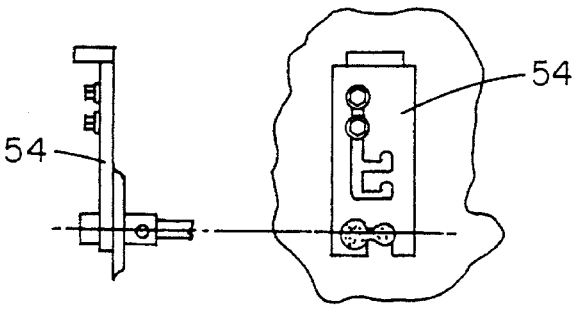
Figure 3D:
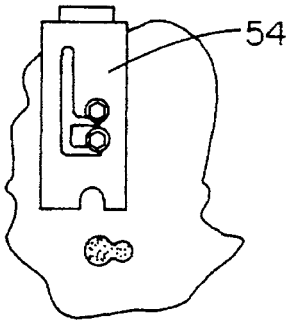

Referring to FIGS. 1 to 6, there is shown a preferred embodiment of the plastering machine. The plastering machine includes a base frame (2) which is of rectangular configuration. The base frame is mounted onto four caster swivel wheels (4) each rotatable 360 degrees about its respective mounting. At least one pair of angled roller wheels (6) are installed at the front end of the base frame (2). These angled roller wheels are mounted onto a pair of hydraulic piston rods (8). Another pair of wheels (10) is mounted onto a second pair of hydraulic piston rods (12). By activating the hydraulic pistons (8, 12), the base frame can be lifted above the ground, so that the caster swivel wheels (4) are free, i.e. no longer in contact with the ground. The pair of angled rollers are mountable onto a angled rail (14). Each of the two pairs of hydraulic pistons (8, 12) can be independently operated so that the base frame and the fixtures thereon can be aligned vertically to any desired angle.

The plastering machine further includes a upright mast assembly (16). The upright mast assembly (16) consists of three frames. The outer frame (18) includes a pair of frame members, and is stationary with one end anchored to the base frame (2). The inner frame (20) is slidable along the outer frame (18) preferably by means of eight to twelve guide rollers (21). The inner frame (20) is secured to a hydraulic piston (22) at appropriate position, preferably at the connecting bar (21) of the inner frame (see FIG. 6). Thus the inner frame (20) can be moved up and down along the outer frame (18) by operating the hydraulic piston (22). A travelling frame (24) is slidable along the inner frame (20) by means of guide rollers (26). The movement of the travelling frame (24) along the inner frame (20) is by means of a hydraulic piston (28) and a chain and sprocket assembly. Thus two independent sliding movements are enabled by the provision of the outer frame, the inner frame and the travelling frame assembly.

To raise the container assembly, the inner frame is first raised, by energizing the hydraulic piston (22). To raise the container assembly further, the second hydraulic piston (28) is energized whereby the travelling frame is raised by sliding along the inner frame (20). The second set of guide rollers (26) facilitates this sliding movement. The frame are lowered by the operation of the hydraulic pistons. A motor (32), a hydraulic pump apparatus (34), and a hydraulic fluid tank (36) are suitably accommodated and mounted onto the base frame so as to be isolated form the outer frame, the inner frame and the container.

The container assembly will now be described by referring to FIGS. 2, 3, 4 and 5. The container (38) is a generally rectangular box with a inclined base. The front panel (40) extends from the top of the container to about 10 cm from the edge of the inclined base to leave a rectangular void. A cutter or smoothening device number (42) is attached to the base of the container (30) and lies along the same plane as the front panel (40). A vibrator means preferably including a vibrator rod (44) is introduceable onto the container. The vibration generator means (46) is powered by the hydraulic pump (34) or the motor (32).

The vibration generator means (46) and the vibration rod (44) are connected by a flexible rubber hose of appropriate design and strength (not shown in illustration).

Figure 4:
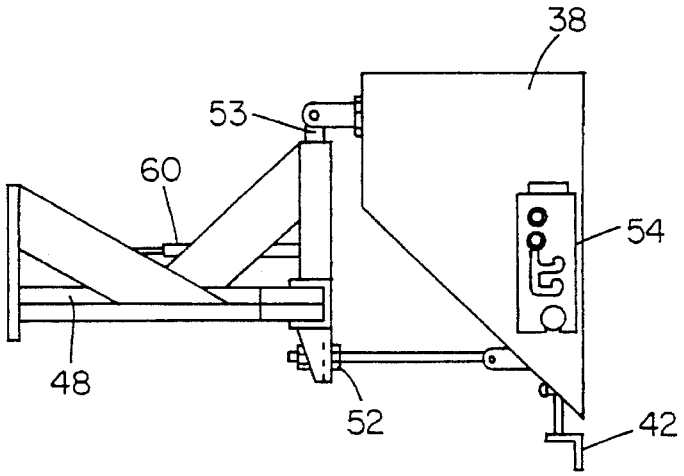
FIG. 4 is an enlarged side view of a container and frame of the preferred embodiment.
Figure 5B:
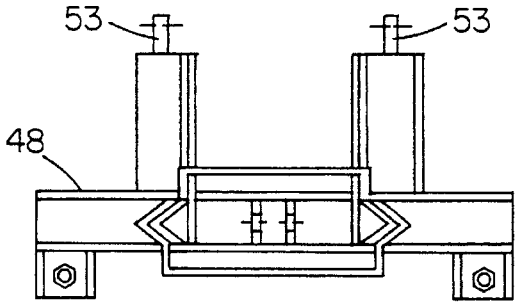
FIG. 5(*a*) and (*b*) are detailed views of the container and frame.
Figure 5A:
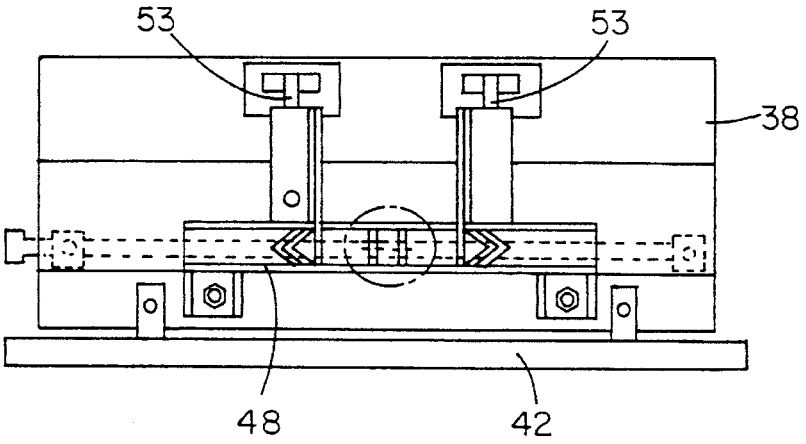
Figure 6A:
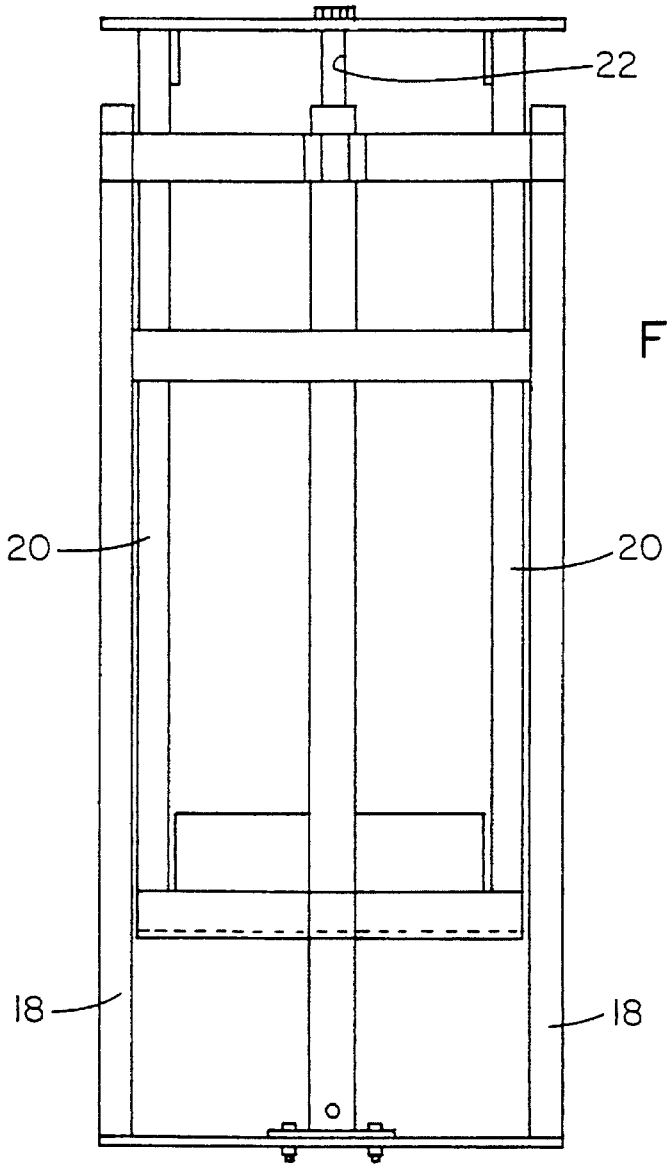
FIG. 6 is a detailed view of the frame assembly.
Figure 6B:
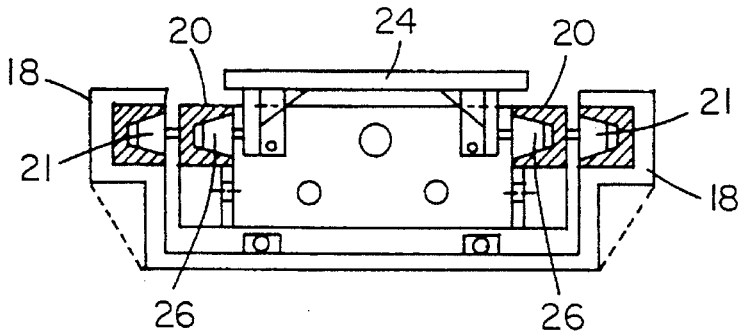

The container (38) is mounted onto the travelling frame (24) by appropriate structural frame-members as shown in FIGS. 4 and 5. To move the container (38) forward, a hydraulic ram is provided. By energizing this hydraulic ram (48), the container can be moved forward towards the wall or withdrawn backwards. The angle of the container or the front panel and the cutter (42) can be adjusted by rod and bolt means (52). The cutter (42) can be independently adjusted by bolts. Alternatively hydraulic means (not shown) can be employed to adjust the position of the cutter (42).

To lock the removable vibrator rod (44) suitable vibrator locking devices (54) are provided on both sides of the container side walls. In the preferred embodiment, the locking device (54) consists of a plate with slots slideable over bolts.

The frames (18, 20) are secured in position by the provision of appropriate frame structures including a turn buckle rod assembly (56). The turn buckle (56) is used to adjust the arm position during the setting up of the machine for plastering. Liquid levels (58) are provided on either side of the outer frames (18) to facilitate level positioning of the machine before commencing the plastering operation. To facilitate the registration of the container distance from the wall, a wall space indicator (60) is provided. The indicator measures the distance of the container from the wall surface. Whenever the machine is moved from one place to another the wall indicator readings are taken at the location. Thereafter the position of the container is adjusted to the corresponding level.

The workings of the machine and other features of the invention will be described now. The machine is moved towards the wall or structure to be plastered and positioned in a manner such that the container is adjusted and parallel to the plane of the wall or the structure. The angled rail (14) is positioned parallel to the plane of the wall or structure and is preferably fixed in the selected position by driving of nails or screws into apertures provided along the length of the rail. The machine is then positioned in registration with the angled rail. The pair of angled roller wheels (6) is then mounted over the angled rail. It will be observed that with the angled roller wheels (6, 10) in a first rest position, they are above the ground level, while the castor swivel wheels are on the ground and are bearing the weight of the machine. Thus it is relatively convenient to move the machine to adjacent the wall or the angled rail, before positioning the angled roller wheels (6) over the rail. The four hydraulic rods (12, 8) are energized so that the wheels are extended downwards thus "lifting" the machine above the ground level, whereby the caster swivel wheels (4) are lifted above the ground. The hydraulic rods are independently adjusted in such a manner that the machine is vertical. The positioning of the machine vertically is facilitated by the liquid level indicators (58).

The container (38) is lowered to the ground wherein the cutter (42) is at ground level. The desired thickness of the plaster to be applied onto the wall is determined. The desired distance of the container (38) from the wall is correspondingly determined and fixed in position. If necessary the hydraulic ram (48) is energized to ensure that the container is at the desired position. The angle of inclination of the container to the wall can be further adjusted if necessary by adjusting the rod and adjusting bolts (52). The vibrator rod (44) is inserted into the container (38) at the front edge of the container and at least one end of the vibrator rod is locked in position by the use of the vibrator locking device (54).

Although the present invention has been described and illustrated in detail, it should be clearly understood that the same is by way of illustration and example only and is not to be taken by way of limitation, the spirit and scope of the present invention being limited only by the terms of the appended claims.

Cement plaster is introduced into the container (38) by any known means, either by pumping plaster into the container or by manual means. The vibrator rod (44) is energised and the container is moved vertically upwards in a controlled manner. The cement mortar is compacted onto the wall, the vibration generated in the mortar in the container, ensuring that the mortar flows downwards by gravitational force. As the container is raised upwards, an even layer of plaster is compacted onto the wall structure by vibration action. The cutter (42) as it moves upwards with the movement of the container (38) ensures that the mortar is smoothened out to produce an even and smooth plastered wall.

At the first stage, the traveling frame and the container is moved vertically upwards by moving the inner frame (20) upwards, by activating the main hydraulic position (22). Once the inner frame reaches the maximum height, the second stage of vertical movement is activated. In the second stage, the second hydraulic piston (28) is activated, the traveling frame (24) moves upwards along the inner frame (20). The configuration of the outer pair of frame (18), the inner pair of frame (20) and the traveling frame (24) is similar to that found in fork-lift truck where the forks are mounted to a traveling frame, in corresponding relationship to the traveling frame and the container (38) in this invention. Once a rectangular patch of wall is plastered, the container is withdrawn backwards and is lowered to the ground level, the machine is moved laterally along the angular rail to the next position such that edge of the container is at the edge of the rectangular patch to be plastered. The process is repeated as described earlier.

The speed of the movement of the container upwards and the rate of vibration has to be coordinated so that the cement mortar is effectively plastered.

The hydraulic rams, are powered by a hydraulic pump (34), the hydraulic control levers (62) are conveniently located towards the side edge of the machine, so that it is convenient for the operator to stand adjacent to the machine and operate the control levers. The hydraulic fluid tank (36) is conveniently located beneath the hydraulic pump, on top of the base frame (2). For convenience, the vibration generating means is positioned at the back of the machine, adjacent to the hydraulic levers.

Vibration forces are transferred to the vibrator rod by means of a suitable detachable rubber hose (not shown).

The present embodiment is desired to be easily disassembled and assembled at site, thus enhancing the flexibility of the machine. The size, in particular the length of the container can be varied so that at each upward movement of the container a larger surface area of the wall can be plastered.

The entire machine can be conveniently motorised, so that an operator can move the machine from one point to another, just similar to the operation of fork-lift trucks. Alternatively the hydraulic pump, hydraulic tank and the hydraulic control levers can be isolated from the machine.

It has been found in practice that the use of the machine as described above, greatly increases the rate of plastering of wall. Further the finish of the surface area after plastering is much smoother and even as compared to the manual operations. The strength of the plaster compacted onto the wall surface is stronger as compared to that plastered surface produced in manual operation.

I claim:

1. A plastering machine to apply cement-sand mortar plaster onto a planar vertical surface, comprising:

i) a container secured to a frame assembly means capable of vertical movement to hold and to apply cement-sand mortar plaster onto the planar surface; and ii) a vibration means to compact the cement-sand mortar plaster onto the planar vertical surface.

2. A plastering machine as claimed in claim 1, wherein:

the frame assembly means includes an outer pair of frame members which are non-movably fixed onto a base frame and an inner pair of frame members longitudinally movable along the outer pair of frame members.

3. A plastering machine as claimed in claim 2, further comprising:

a travelling frame member, movable along the inner pair of frame members and to which the container is secured.

4. A plastering machine as claimed in claim 3, wherein:

the travelling frame member is secured to rollers which are slideable along a pair of grooves formed in the inner pair of frame members.

5. A plastering machine as claimed in claim 1, wherein:

the container is supported to means for enabling movement of the container toward and away from the planar vertical surface along a horizontal direction.

6. A plastering machine as claimed in claim 1, wherein:

the vibration means includes a longitudinal vibration rod disposed horizontally along a length of the container.

7. A plastering machine as claimed in claim 1, further comprising:

means for smoothening the plaster on the vertical planar surface.

8. A plastering machine as claimed in claim 7, wherein:

the means to smoothen the plaster on the vertical planar surface comprises an elongate member and is positioned below a base of the container.

9. A plastering machine as claimed in claim 6, wherein:

the vibration rod is detachably attached to the container.

10. A plastering machine as claimed in claim 1, wherein:

the machine is mounted on plurality of wheels comprising at least two front wheels which are angled roller wheels and are moveable along a grounded angle rail.

11. A plastering machine as claimed in claim 10, further comprising:

means for aligning the machine at a desired inclination to a vertical direction by independently adjusting respective corners of the base frame of the machine relative to ground level.

12. A plastering machine as claimed in claim 4, further including:

a hydraulic pump, motors and hydraulic controls for actuating the vibration means, the travelling frame member, and the container, mounted so as to be isolated from the outer pair of frame members, the inner pair of frame members, and the container.

* * * * *